US007410080B2

(12) United States Patent
Good

(10) Patent No.: US 7,410,080 B2
(45) Date of Patent: Aug. 12, 2008

(54) HOLDING APPARATUS AND METHOD FOR DISPENSERS OF HARDENABLE MATERIALS

(76) Inventor: Kelly Good, 209 Judy Ave., Burlington, WA (US) 98233-2825

( * ) Notice: Subject to any disclaimer, the term of this patent is extended or adjusted under 35 U.S.C. 154(b) by 966 days.

(21) Appl. No.: 10/606,627

(22) Filed: Jun. 25, 2003

(65) Prior Publication Data

US 2004/0140333 A1 Jul. 22, 2004

Related U.S. Application Data

(63) Continuation-in-part of application No. 10/367,088, filed on Feb. 14, 2003, now abandoned.

(60) Provisional application No. 60/392,288, filed on Jun. 26, 2002.

(51) Int. Cl.
*A45F 3/10* (2006.01)

(52) U.S. Cl. ..... 224/269; 224/665; 224/678; 224/679; 224/904; 224/251; 248/109; 248/136; 248/688

(58) Field of Classification Search ..... 224/148.7, 224/665–667, 677–679, 269, 904, 222, 223, 224/660, 546, 185, 245, 251; 222/546; 215/320; 206/229, 384; 248/108–109, 136, 688; 211/70.6, 211/60.1

See application file for complete search history.

(56) References Cited

U.S. PATENT DOCUMENTS 4,326,648 A 4/1982 Kieber
4,588,116 A * 5/1986 Litman ..... 224/672
4,830,247 A 5/1989 Banks
5,080,240 A 1/1992 Williams
5,232,137 A 8/1993 Devine
5,295,601 A * 3/1994 Bostelman ..... 215/320
5,302,302 A * 4/1994 Shelley et al. ..... 224/148.7
5,609,283 A 3/1997 Harrison
5,620,163 A * 4/1997 Wu ..... 248/688
5,788,194 A 8/1998 Van Den Berg
D409,381 S 5/1999 Cleveland et al.
D420,216 S 2/2000 Birkbeck, III
6,325,261 B1 12/2001 Webber
6,367,110 B1 4/2002 Urueta et al.

* cited by examiner

*Primary Examiner*—Tri M Mai
(74) *Attorney, Agent, or Firm*—Michael R. Schacht; Schacht Law Office, Inc.

(57) ABSTRACT

A holding system for a dispensing system for hardenable materials comprising a dispensing gun and a product cartridge having a dispensing tip defining a dispensing opening. The holding system comprises a holding structure and a plug projection. Optionally, one or more guide ribs may be used. The holding structure comprises a side wall and a bottom wall and defines a main opening and a cartridge chamber. The plug projection extends from the bottom wall into the cartridge chamber. The at least one guide rib extends from the side wall into the cartridge chamber. The cartridge chamber is sized and dimensioned to receive the product cartridge. When the product cartridge is placed into the cartridge chamber, the guide rib is arranged to engage a portion of the dispensing system to facilitate entry of the plug projection into the dispensing opening. Optionally, one or more wall openings may be formed in the holding structure adjacent to the plug projection.

20 Claims, 9 Drawing Sheets

FIG. 23
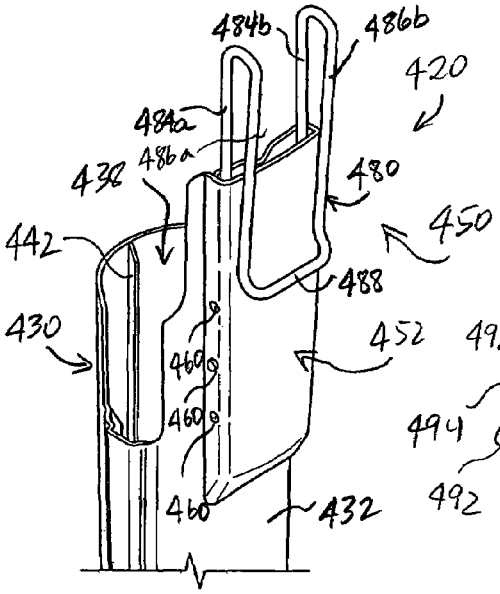
FIG. 24
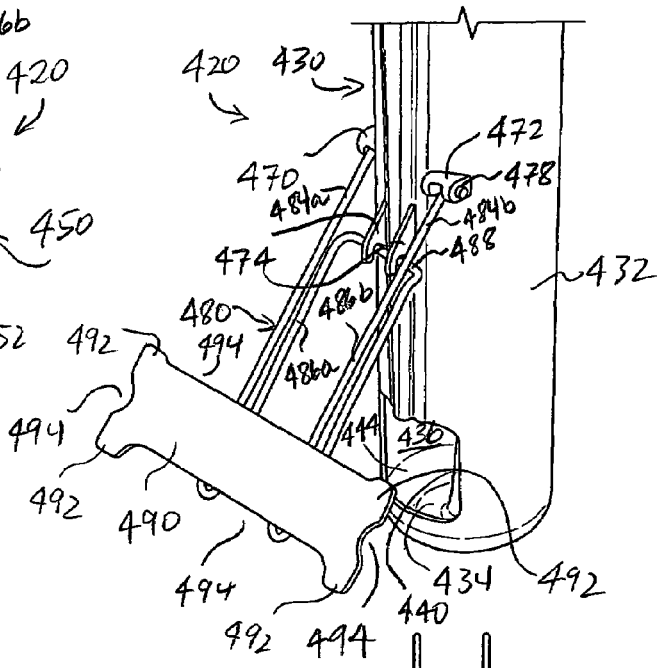
FIG. 25A
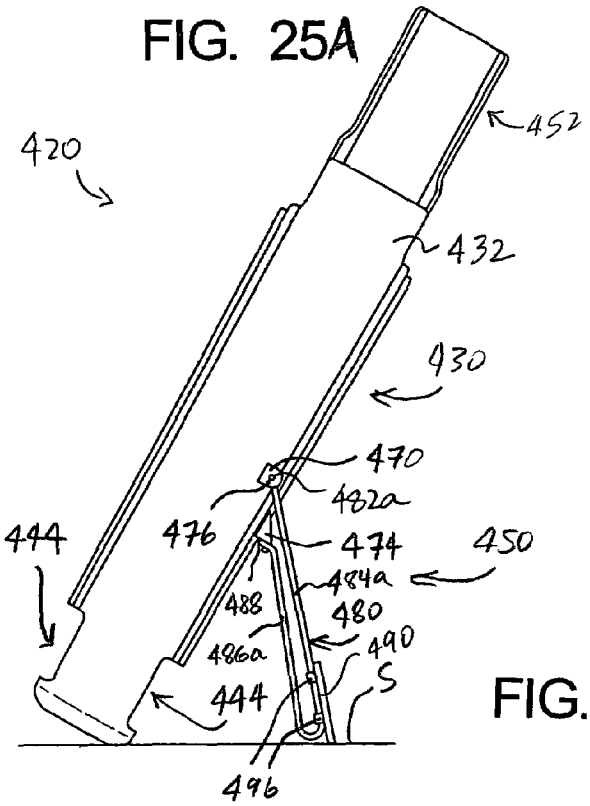
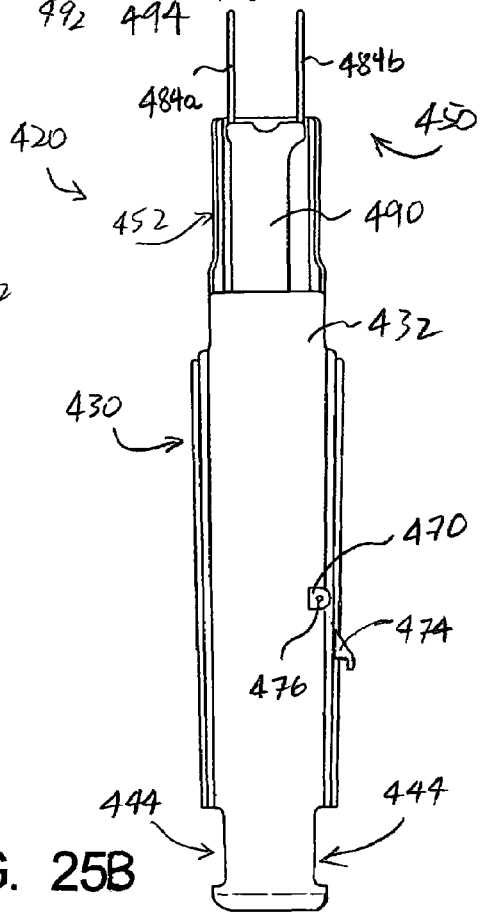
FIG. 25B

HOLDING APPARATUS AND METHOD FOR DISPENSERS OF HARDENABLE MATERIALS

RELATED APPLICATIONS

This is a continuation-in-part of U.S. patent application Ser. No. 10/367,088 filed Feb. 14, 2003 now abandoned, which claims priority of U.S. Provisional Patent Application Ser. No. 60/392,288 filed Jun. 26, 2002.

FIELD OF THE INVENTION

The present invention relates to systems and methods for storing dispensers of hardenable material and, more specifically, to systems and methods for storing dispensing gun assemblies containing opened cartridges of hardenable materials.

BACKGROUND OF THE INVENTION

Many construction tasks require the application of hardenable materials. The term "hardenable" is used herein to refer materials that dry upon exposure to air such that they are no longer flowable. A hardenable material that has dried upon exposure to air may retain some resiliency; the term "hardenable" thus does not necessarily suggest that a hardenable material is rigid or unyielding when dry.

The types of hardenable materials employed during construction tasks include caulking materials, construction adhesives, and the like. These types of hardenable materials are typically viscous upon manufacture and remain flowable when not exposed to air. Typically, the hardenable material is formulated such that the material is no longer flowable anywhere from five minutes to two hours after exposure to air. Accordingly, hardenable materials used during construction are typically manufactured, shipped, and sold in a sealed storage container. Immediately prior to use, a dispensing opening is formed in the sealed storage container through which the hardenable material may be dispensed.

Some hardenable materials may be dispensed directly from the storage container. For example, certain caulking materials are sold in a deformable tube having an integral dispensing tip. Once the dispensing tip has been cut to form a dispensing opening, the tube is squeezed to dispense the caulking material through the dispensing opening.

For a variety of reasons, other hardenable materials can not be easily or conveniently dispensed by applying pressure directly to the storage container. Some hardenable materials are simply too viscous to be dispensed by direct hand pressure to the container. Other hardenable materials must be dispensed in relatively large quantities, and the use of direct hand pressure can cause operator fatigue.

Accordingly, many hardenable materials are dispensed using a dispensing system comprising dispensing gun and a product cartridge. A dispensing gun uses a lever to displace an actuator rod that forces the hardenable material out of the product cartridge. The operator applies hand pressure to the lever which in turn acts on the rod, thereby creating a mechanical advantage that assists in the dispensing of the material. Typically, dispensing guns allows highly viscous materials to be dispensed using hand pressure. Dispensing guns can also allow an operator to dispense relatively larger quantities of the hardenable material without fatigue. Some types of dispensing guns may assist the operator using electric, hydraulic, pneumatic, or other systems for generating mechanical forces.

When a hardenable material is to be dispensed using a dispensing gun, the hardenable material is typically stored in the product cartridge prior to use. The product cartridge typically comprises a paperboard cylinder, a dispensing tip, and a floating piston member. The dispensing tip is attached to a first end of the cylinder, and the piston member is initially position within the cylinder adjacent to a second end thereof. When originally manufactured, the entire cartridge is substantially air tight to prevent the hardenable material from drying prior to use.

Immediately prior to use, the cartridge is placed in the dispensing gun with the piston member adjacent to the actuator rod. The dispensing tip is also cut or pierced to form a dispensing opening. The operator arranges the dispensing opening adjacent to the surface where the material is to be dispensed. The operator then applies manual force to the lever. The lever forces the actuator rod against the piston member, is which in turn applies pressure to the hardenable material. The pressure on the hardenable material causes the hardenable material to flow out of the dispensing opening.

Once the dispensing opening has been formed, the cartridge is no longer air-tight. In particular, the hardenable material in the dispensing tip adjacent to the dispensing opening is in direct contact with the air. If the material within the dispensing tip is allowed to dry out, the dispensing opening may become blocked, and the entire cartridge may be unusable.

As long as the operator continues to operate the dispensing gun, the hardenable material in the dispensing tip does not have a chance to dry out. Often, however, the operator will be interrupted while using a dispensing gun with an opened cartridge of hardenable material. If the interruption is longer than the drying time of the hardenable material, the dispensing opening may become blocked and the cartridge may become unusable. Typically, an operator will simply discard a cartridge that has become blocked regardless of how much material remains within the cartridge. A similar situation occurs at the end of the day or when the operator completes a job.

Another problem with existing dispensing systems arises from the back pressure created by the relatively viscous hardenable materials. When the lever is actuated to displace the actuator rod and piston member, a relatively high pressure zone is created within the cartridge. The viscosity of the hardenable material typically creates a back pressure that causes the high pressure within the cartridge to decay over time. Accordingly, the pressure within the cylinder persists after the pressure is no longer applied by the piston member. This residual pressure continues to cause the hardenable material to flow out of the dispensing opening after the operator has stopped actuating the lever. The operator must wait for the residual pressure to dissipate or find a place where excess hardenable material can be dispensed. The flow of dispensing material caused by residual pressure within the cartridge can thus reduce the productivity of the operator.

Another problem with conventional dispensing systems is where to put the dispensing gun when not in use. For example, an operator could be using a construction adhesive while framing a house. In this case, the operator may apply the adhesive to secure one step board to another nail the two boards together, and then fetch the next board. When the operator is nailing the first two boards together and fetching the next board, the dispensing gun must be temporarily stored at an out of the way location until the adhesive is to be used with the next board. This temporary storage is complicated by the continued flow of material caused by residual pressure within the cartridge.

From the foregoing, it should be apparent that the need exists for systems and methods for holding dispensers for hardenable materials.

SUMMARY OF THE INVENTION

The present invention is a holding system for a dispensing system for hardenable materials. The dispensing system conventionally comprises a dispensing gun and a product cartridge having a dispensing tip defining a dispensing opening. The holding system comprises a holding structure and a plug projection. The holding structure comprises a side wall and a bottom wall and defines a main opening and a cartridge chamber. The plug projection extends from the bottom wall into the cartridge chamber. The at least one guide rib extends from the side wall into the cartridge chamber. The cartridge chamber is sized and dimensioned to receive the product cartridge. Optionally, one or more guide ribs may be used. When the product cartridge is placed into the cartridge chamber, the guide rib is arranged to engage a portion of the dispensing system to facilitate entry of the plug projection into the dispensing opening. Optionally, one or more wall openings may be formed in the holding structure adjacent to the plug projection.

BRIEF DESCRIPTION THE DRAWING

FIG. 23 is a perspective view of a portion of another exemplary holding system constructed in accordance with, and embodying, the principles of the present invention;

FIG. 24 is a perspective view of another portion of the holding system of FIG. 23;

FIGS. 25A and 25B are side elevation views of free-standing and hanging configurations of the holding system of FIG. 23.

DETAILED DESCRIPTION OF THE PREFERRED EMBODIMENTS

Figure 1:
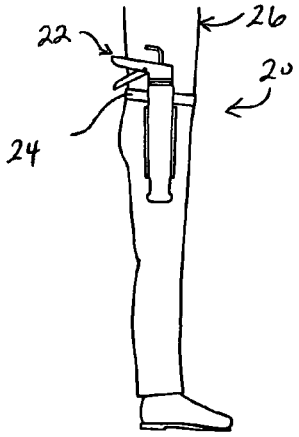
FIG. 1 is a side elevational view showing one exemplary holding system of the present invention supporting a dispensing gun from the belt of an operator.

Referring initially to FIG. 1, depicted therein is a holding system 20 constructed in accordance with, and embodying, the principles of the present invention. The holding system 20 is shown supporting a dispensing assembly 22 in a desired relationship from a belt 24 worn by an operator 26.

Figure 2:
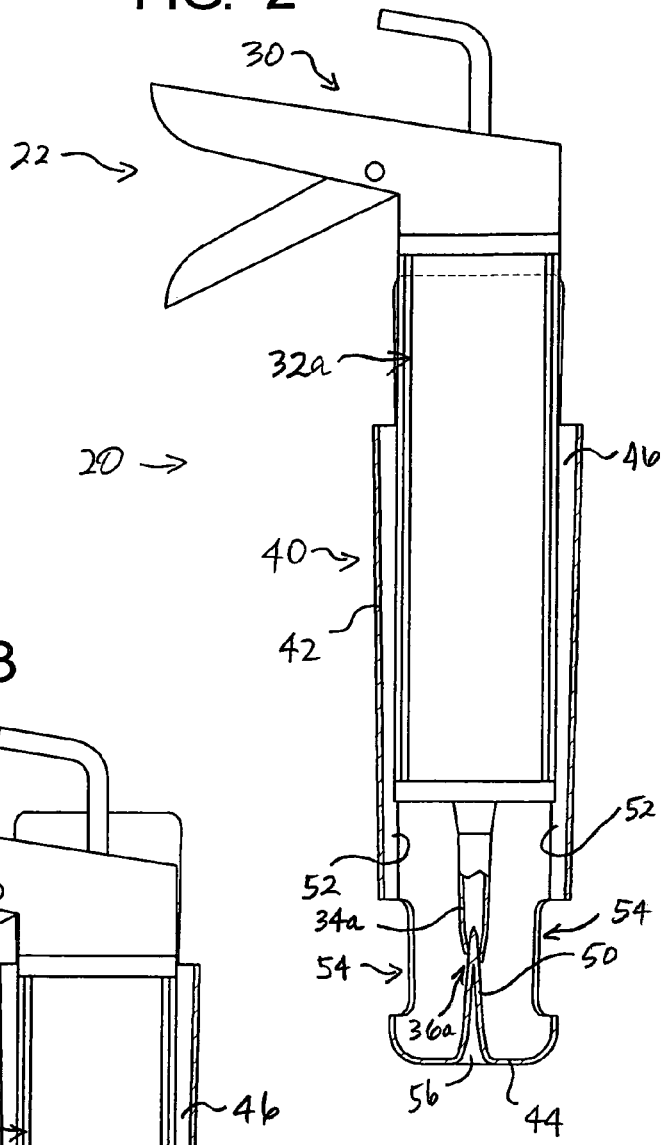
FIG. 2 is a sectional view taken through a longitudinal center line of the holding system of FIG. 1, also showing in section the dispensing gun supported thereby.
Figure 3:
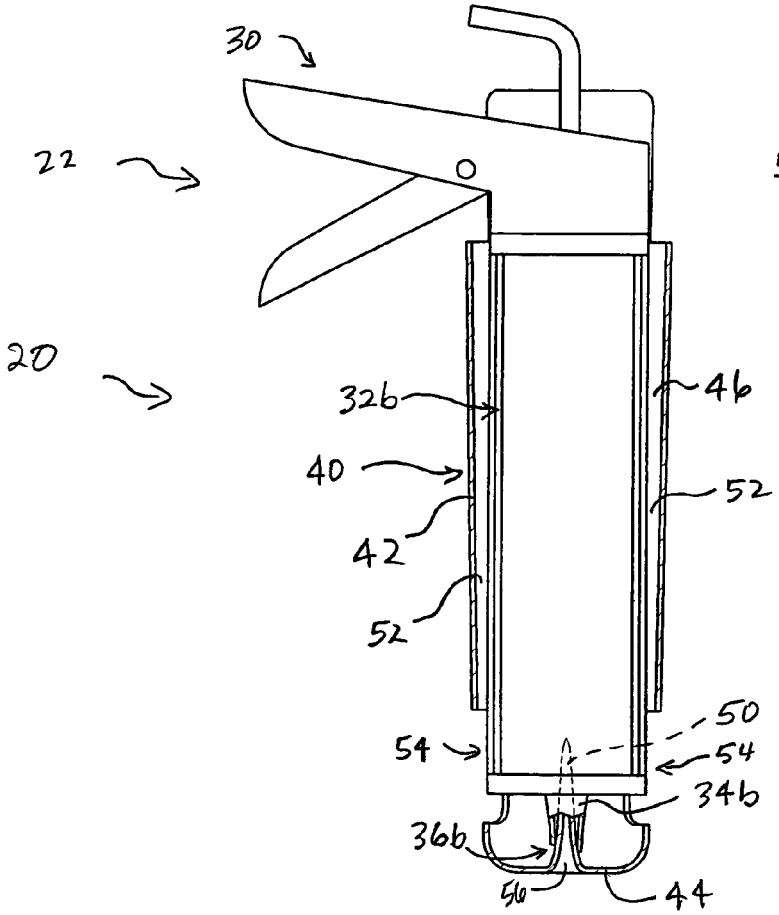
FIG. 3 is a sectional view taken through a longitudinal center line of the holding system of FIG. 1, also showing in section another example of a dispensing gun supported thereby.

The dispensing assembly 22 is or may be conventional and will be described herein only to the extent necessary for a complete understanding of the present invention. As shown in FIGS. 2 and 3, the dispensing assembly 22 comprises a dispensing gun 30 and a product cartridge 32. The product cartridge 32 defines a dispensing tip 34. The dispensing tip 34 has been cut or pierced to define a tip opening 36. In the following discussion, a suffix "a" or "b" will be used to identify individual tips 34 with different sizes of tip openings 36.

The form factor of the product cartridge 32 has been relatively standardized in the marketplace, although conventional product cartridges come in different sizes. Dispensing guns 30 are manufactured to accept the form factor of the product cartridge 32 in each of the different sizes.

Figure 9:
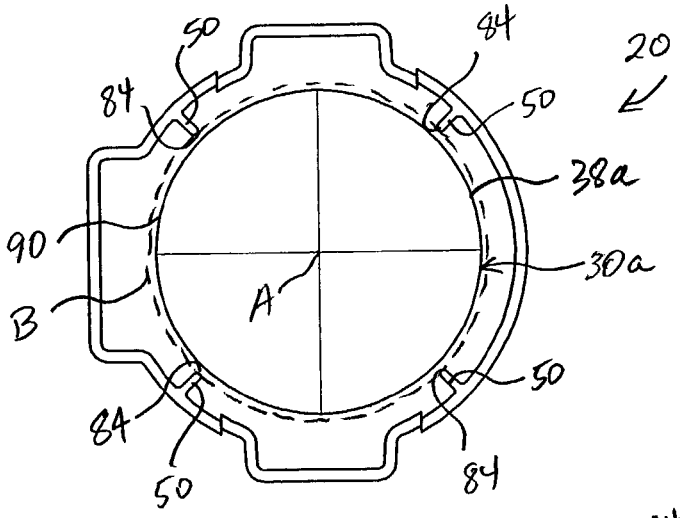
FIGS. 9-11 are top plan views showing the exemplary holding system of FIG. 1 accommodating dispensing guns of different form factors.
Figure 10:
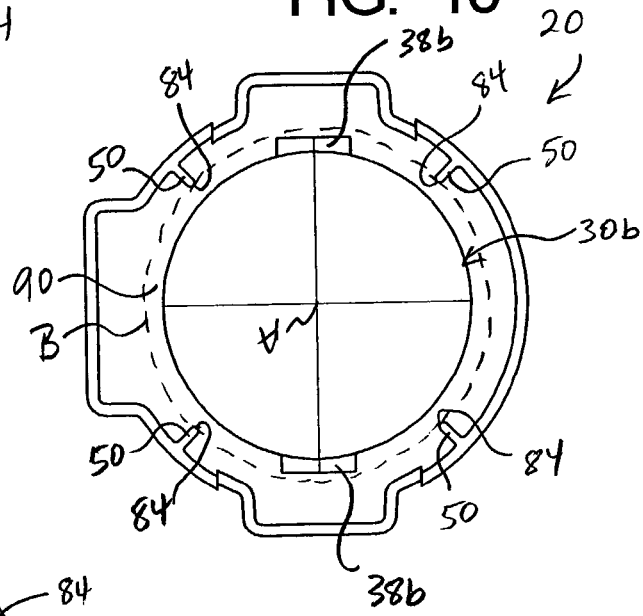
Figure 11:
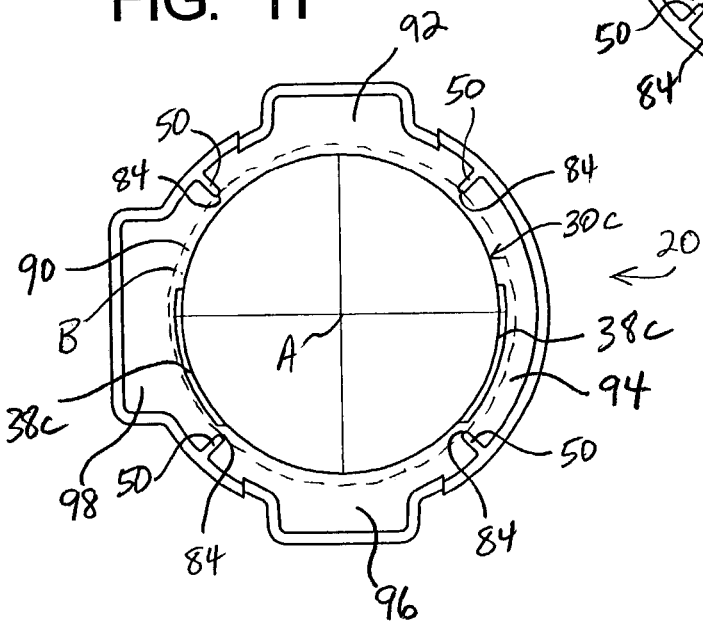

The designs of the dispensing guns are not standardized. In particular, FIGS. 9-11 illustrate three different dispensing gun configurations 30*a*, 30*b*, and 30*c*each having a unique structure and defining a unique projection 38*a*, 38*b*, and 38*c*, respectively. The exact details of any one of the projections 38 are not critical to the present invention other than to note that the exemplary holding system 20 accommodates each of these projections 38 as will be described in further detail below.

As perhaps best shown in FIGS. 2-8, the holding system 20 comprises a holding structure 40 having a side wall 42 and a bottom wall 44. The holding structure 40 defines a holding chamber 46 and a main opening 48. Extending from the bottom wall 44 into the holding chamber 46 is a plug projection 50. In addition, a plurality of guide ribs 52 extend from the side wall 42 into the holding chamber 46.

Optionally, one or more wall openings 54 may be formed in the side wall 42 adjacent to the plug projection 50. The exemplary holding structure 40 defines two wall openings 54. Additionally, in the exemplary system 20, a projection cavity 56 is formed in the bottom wall 44 below the plug projection 54. A lower portion 58 of the holding chamber 46 is located between the plug projection 50 and the wall openings 54.

Figure 4:
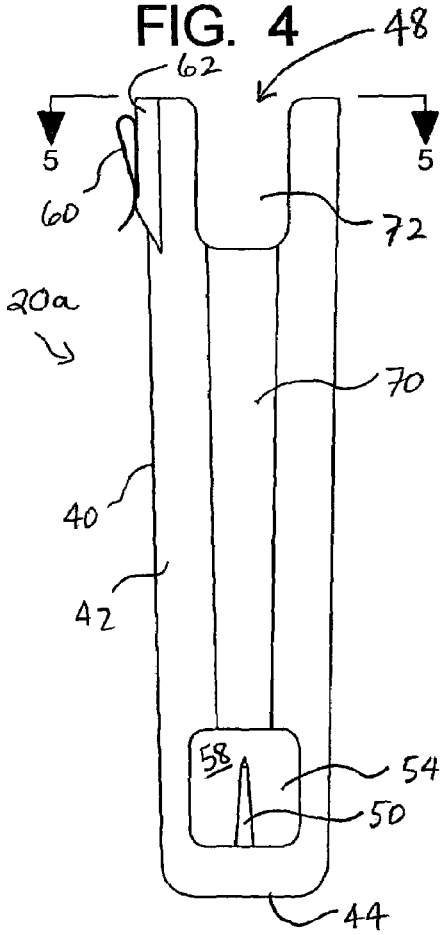
FIG. 4 is a side elevational view showing the exemplary holding system of FIG. 1 in further detail.
Figure 6:
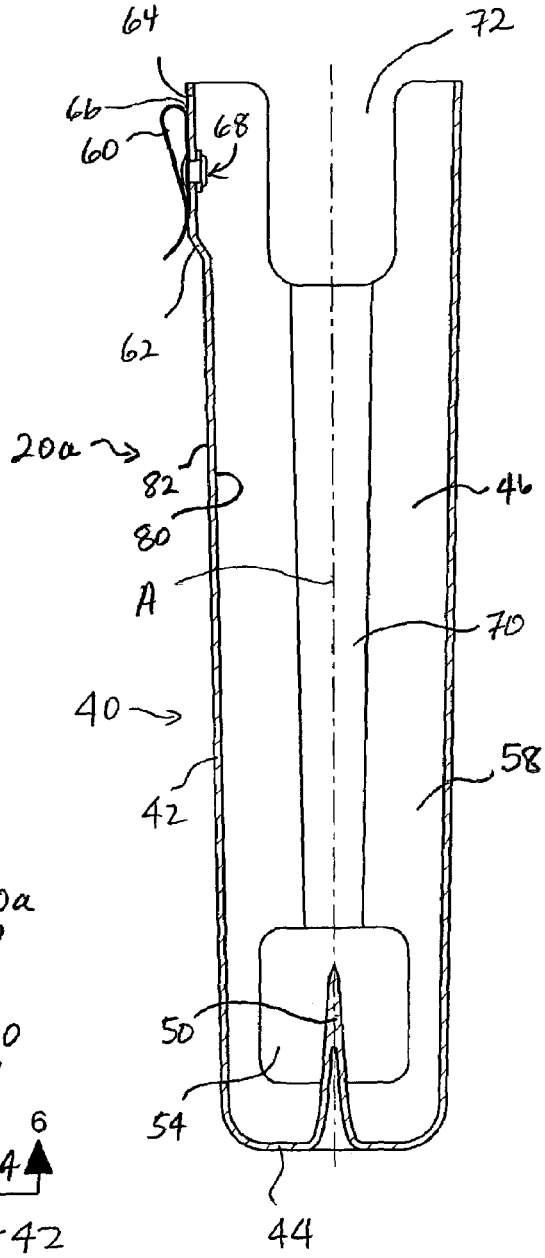
FIG. 6 is a sectional view taken along lines 6-6 in FIG. 5.

FIGS. 4 and 6 illustrate the details of a belt clip 60 that may be optionally used to facilitate suspending the holding structure 40 from the operator's belt 24 as shown FIG. 1. In the exemplary holding system 20, a clip projection 62 defining a clip wall 64 is formed on the holding structure 40 adjacent to the main opening 48. The clip wall 64 defines a flat surface 66 appropriate for mounting of the clip 60. FIG. 6 illustrates a rivet assembly 68 that may be used to attach the clip 60 to the holding structure 40, but other attachment systems may be used. In addition, the clip 60 can be integrally formed with the holding structure using some manufacturing techniques and materials.

The use of the holding system 20 will now be described with reference to FIGS. 2 and 3. As shown, at least a portion of the dispensing assembly 22 is extended through the main opening 48 and into the holding chamber 46. In FIGS. 2 and 3, the dispensing assembly 22 is shown in two storage positions relative to the holding structure 40. In the storage position shown in FIG. 2, a smaller tip opening 36*a* receives a portion of the plug projection 50. In the storage position shown in FIG. 3, a relatively larger tip opening 36*b* receives a larger portion a portion of the plug projection 50. The plug projection 50 engages the dispensing tip 34 to block the tip opening 36 and thus inhibit interaction of the material within the cartridge 32 and the ambient air.

When the dispensing assembly 22 is in the storage position, the plug projection 50 thereby inhibits drying of the material within the cartridge 32. The operator 26 can thus leave the dispensing assembly 22 in the storage position without drying of the hardenable material in the dispensing tip 34 for a period of time substantially longer than if the dispensing assembly 22 is left unprotected.

In FIG. 2, the dispensing tip 34*a* depicted therein is cut to define a relatively smaller tip opening 36*a*, while in FIG. 3 the dispensing tip 34*b* is cut to define a relative larger tip opening 36*b*. The exemplary plug projection 50 is conical in shape to accommodate either of these sizes of tip openings 36*a* or 36*b*.

When the belt clip 60 is used, the holding structure 40 may be secured in a conventional manner to the wearer's belt 24. When the holding structure 40 is secured to the wearer's belt 24 and the dispensing assembly 22 is in the storage position, the dispensing assembly 22 may easily be carried and stored while the operator 26 moves about or works on other tasks.

The guide ribs 52 are arranged to facilitate placement by the operator 26 of the dispensing assembly 22 into the storage position. As will be described in further detail below, the guide ribs 52 are arranged to guide the dispensing assembly 22 along a center line A of the holding structure 40 such that the tip opening 36 receives the plug projection 50.

The wall openings 54 allow easy access to a portion of the holding chamber 46 adjacent to the bottom wall 44 where the plug projection 50 is located. The wall openings 54 thus allow any hardenable material that accumulates in the lower portion 58 of the holding chamber 46 around the plug projection 50 to be removed without having to reach through the main opening 48. The wall openings 54 further allow the operator 26 to reach into the lower portion 58 of the holding chamber 46 to help guide the plug projection 40 into the tip opening 36.

Figure 5:
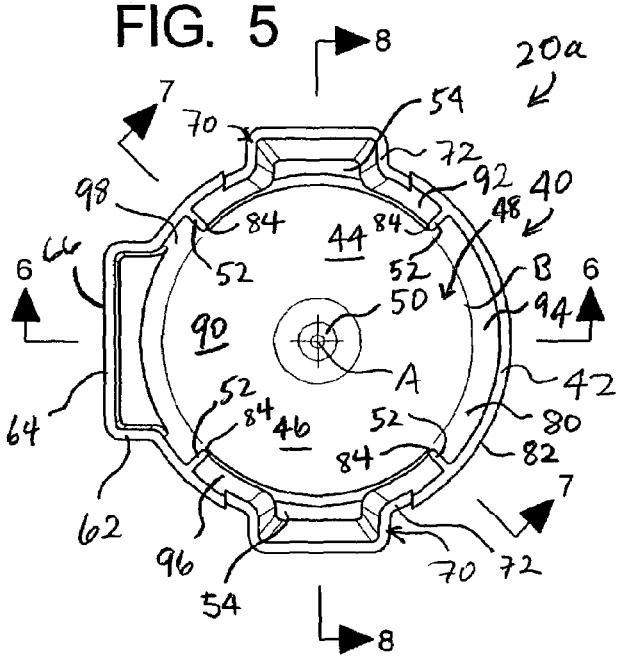
FIG. 5 is a top plan view showing the exemplary holding system of FIG. 1 in further detail.
Figure 7:
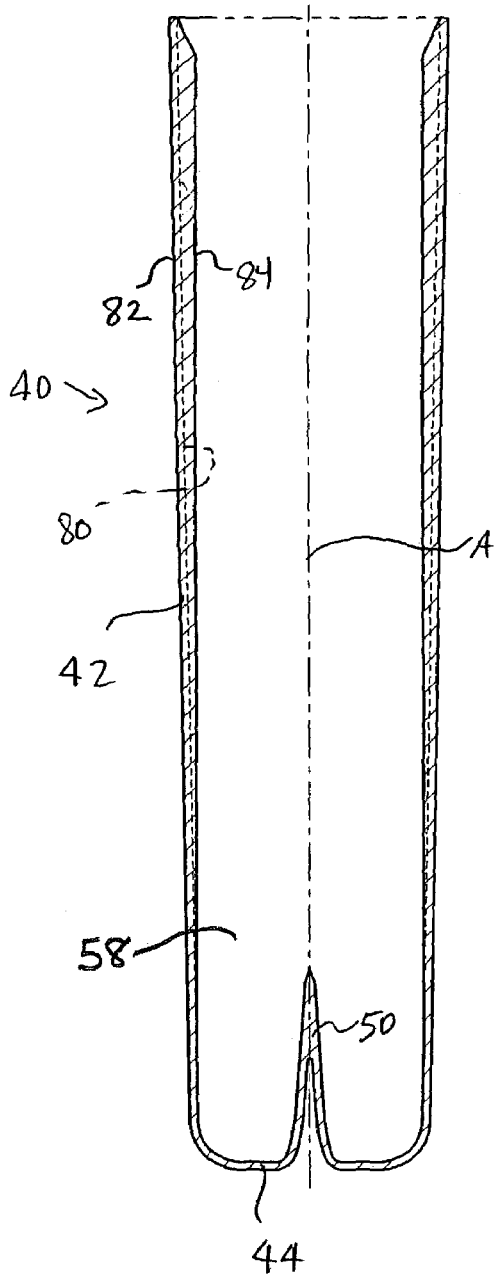
FIG. 7 is a sectional view taken along lines 7-7 in FIG. 5.
Figure 8:
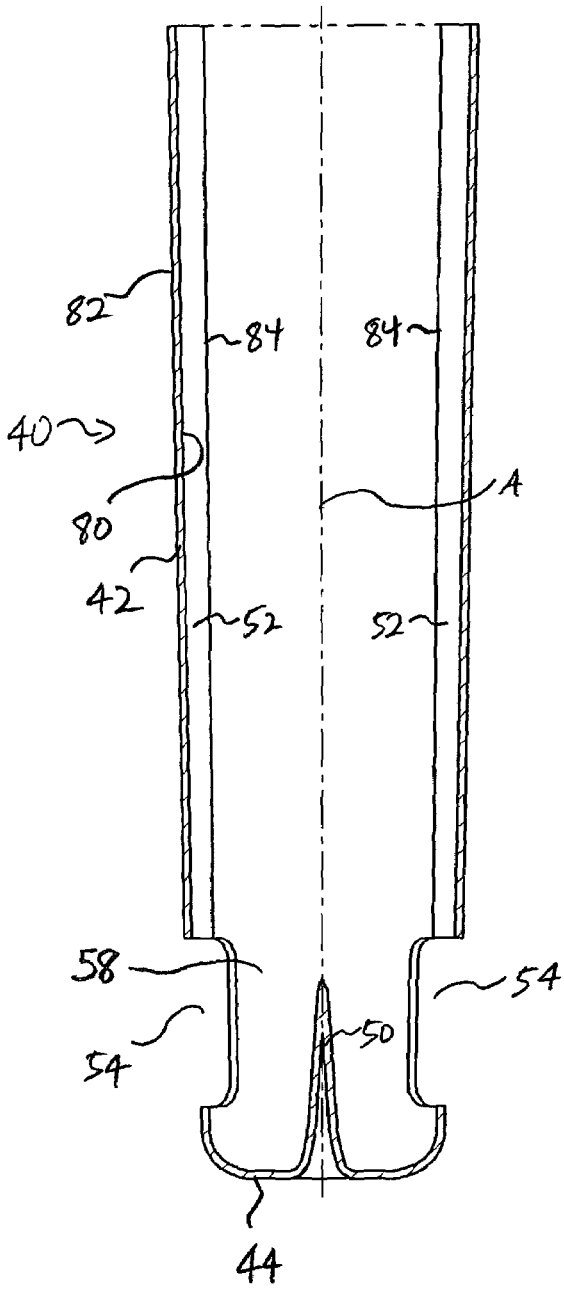
FIG. 8 is a sectional view taken along lines 8-8 in FIG. 5.

FIGS. 4-6 illustrate that, in the exemplary holding system 20, optional wall projections 70 and wall notches 72 are formed in the side wall 42 of the holding structure 40. The wall projections 70 and wall notches 72 allow certain types of the dispensing guns 30 to be placed into the holding chamber 46 without interference by the holding structure 40. The use of the wall projections 70 instead of longer wall notches 72 increases the strength of the holding structure 40. The use of two sets of projections 70 and notches 72 allows the holding system 20 to be used on either the right or left side of the wearer 26 with the dispensing gun 30 facing either forward or backwards relative to the wearer 26.

Referring now to FIGS. 5 and 6, these figures show that the side wall 42 defines an inner surface 80 and an outer surface 82, and FIG. 5 shows that the guide ribs 52 define rib edges 84. The rib edges 84 are substantially parallel to the centerline A, while the inner surface 80 is slightly angled with respect to the centerline A. The angled inner surface 80 facilitates the manufacture of the holding structure 40 using the injection molding process, while the parallel rib edges 84 guide the dispensing assembly 22 into the holding chamber 46.

More specifically, as shown in FIG. 5, the rib edges 84 define a profile cylinder B (extending out of the page in FIG. 5). The profile cylinder B divides the holding chamber 46 into a central portion 90 and front, outer, rear, and inner (with respect to the operator 26) perimeter portions 92, 94, 96, and 98. The central portion 90 is sized and dimensioned to receive that portion of the dispensing assembly 22 that is common to most types of dispensing assemblies. As shown in FIGS. 9-11, the perimeter portions 92-98 are sized, dimensioned, and located to accommodate any projections 38*a*, 38*b*, or 38*c* from the dispensing assembly 22 that may be associated with particular dispensing guns 30*a*, 30*b*, and 30*c*.

The holding structure 40 is thus capable of accommodating dispensing assemblies of many different or unknown form factors while still guiding the dispensing assembly 22 into the storage position with the plug projection 50 received by the tip opening 36.

Figure 12:
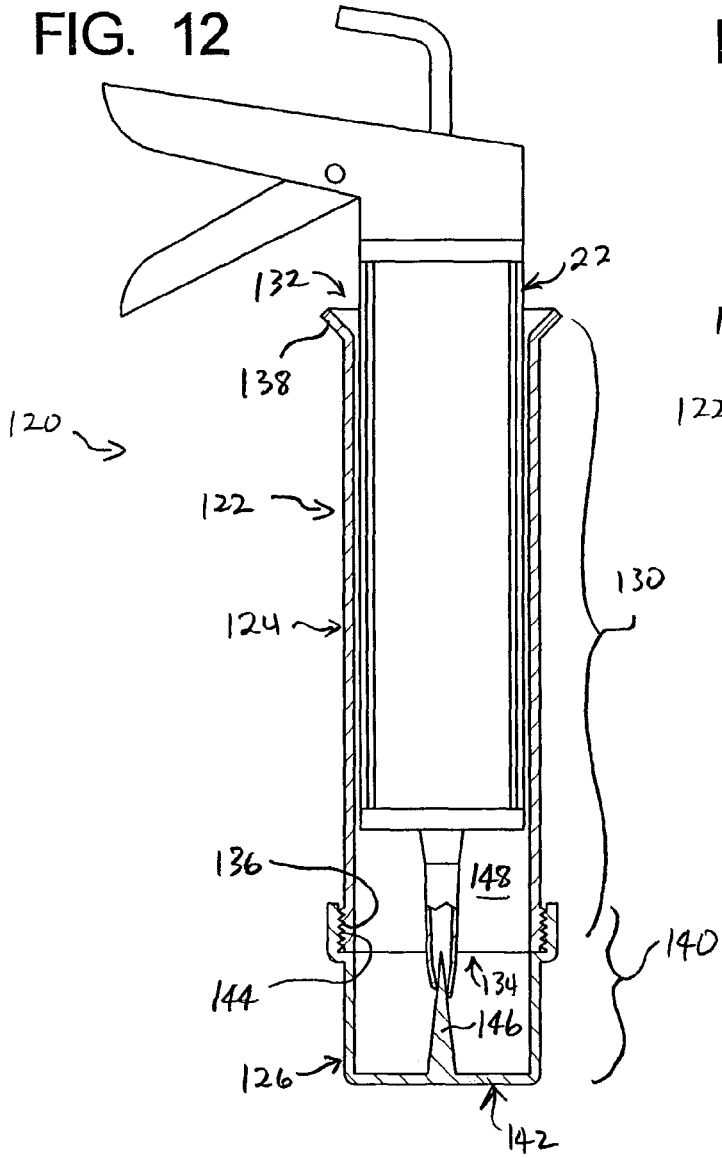
FIG. 12 is a sectional view taken through the longitudinal center line of another exemplary holding system of the present invention shown supporting a dispensing gun.
Figure 13:
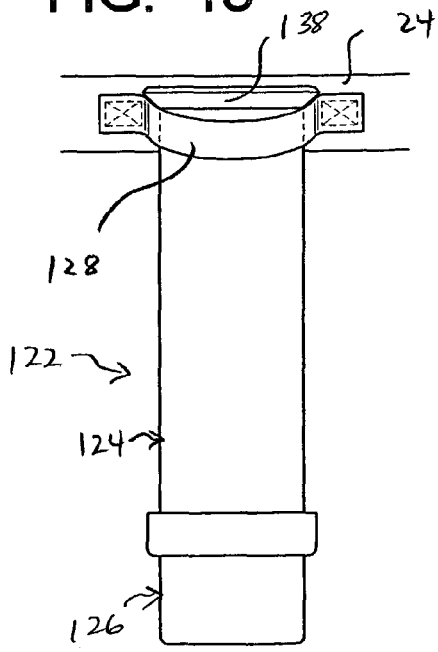
FIG. 13 is a side elevation view of the holding system of FIG. 12 shown being supported by a belt.

Referring now to FIG. 12, depicted therein is yet another holding system 120 constructed in accordance with, and embodying, the principles of the present invention. The holding system 120 comprises a holding structure 122 comprising a barrel portion 124 and a cap portion 126. As shown in FIG. 13, the holding system 120 may be supported by a hammer loop 128 extending from the wearer's belt 24.

The barrel portion 124 of the holding structure 122 comprises a first side wall portion 130 and defines first and second barrel openings 132 and 134. A first threaded portion is formed on the first side wall portion 130 adjacent to the second barrel opening 134. A flange portion 138 is formed on the first side wall portion 130 adjacent to the first barrel opening 132.

The cap portion 126 of the barrel structure comprises a second side wall portion 140 and a bottom wall portion 142. A second threaded portion 144 is formed on the second side wall portion 140. A plug projection 146 extends from the bottom wall portion 142.

The first and second threaded portions 136 and 144 are mated to detachably attach the cap portion 126 to the barrel portion 124 and form the holding structure 122. When the holding structure 122 is formed, a holding chamber 148 is defined, and the plug projection 146 extends into the holding chamber 148.

The first barrel opening 132 corresponds to the main opening 48 of the holding system 20 of the first embodiment described above. Similarly, the plug projection 146 corresponds to the plug projection 50 of the system 20. The construction and use of the holding system 120 are in many respects the same as the construction and use of the holding system 20 described above and will not be described herein again in detail. The primary difference between the systems 20 and 120 is that the cap portion 126 may be removed to allow cleaning of the area around the plug projection 50.

Figure 14:
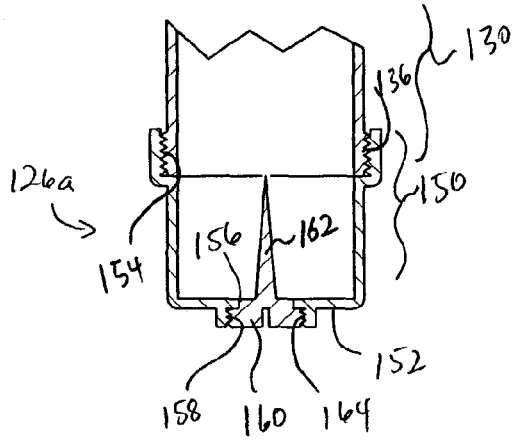
FIG. 14 is a partial sectional view taken through the longitudinal center line of yet another exemplary holding system of the present invention.
Figure 15:
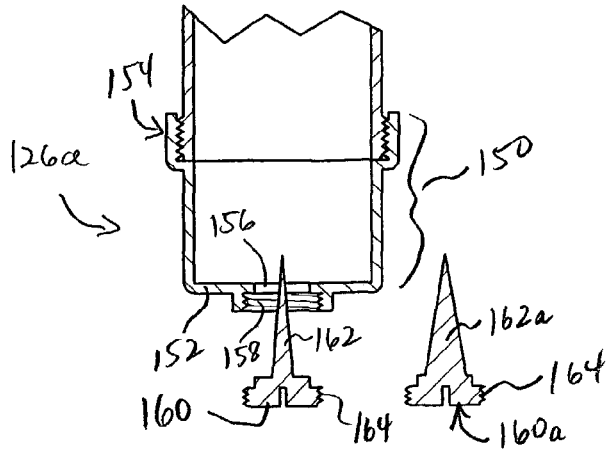
FIG. 15 is an exploded, partial sectional view taken through the longitudinal center line of the exemplary holding system of FIG. 14.

Referring now to FIGS. 14 and 15, depicted at 150 therein is an alternative embodiment 126*a* of the cap portion 126. In particular, the cap portion 126*a* defines a second side wall portion 150 and bottom wall portion 152. A second threaded portion 154 is formed on the second side wall portion 150, and a plug opening 156 is formed in the bottom wall portion 152. A third threaded portion 158 is formed in the bottom wall portion 152 around the plug opening 156. The cap portion

126*a* comprises a projection member 160 defining a plug portion 162 and a fourth threaded portion 164.

As with the cap portion 126 described above, the second threaded portion 154 of the cap portion 126*a* engages the second threaded portion 136 on the barrel portion 124 to form a holding structure. Additionally, the fourth threaded portion 164 of the projection member 160 engages the third threaded portion 158 to detachably attach the plug portion 162 to the cap portion 126*a*. As shown in FIG. 15, different plug members 160 and 160*a*, each defining a plug portion 162 and plug portion 162*a* having a different size and shape, may be used. Accordingly, with smaller tip openings 36, the plug member 160 may be used, and with larger tip openings 36, the plug member 160*a* may be used. These principles may also be applied to the holding structure 40 described above.

Figure 16:
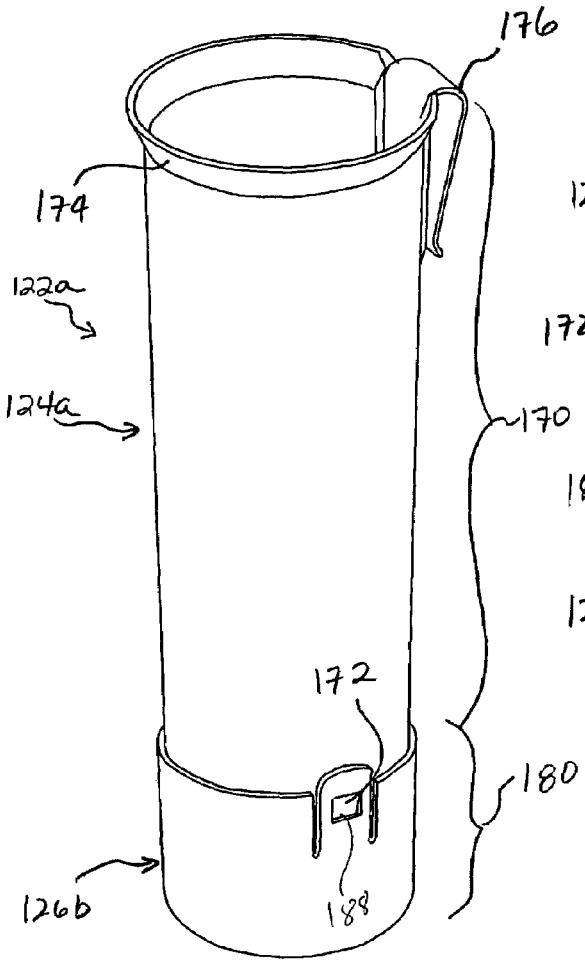
FIG. 16 is a perspective view of yet another exemplary holding system of the present invention.
Figure 17:
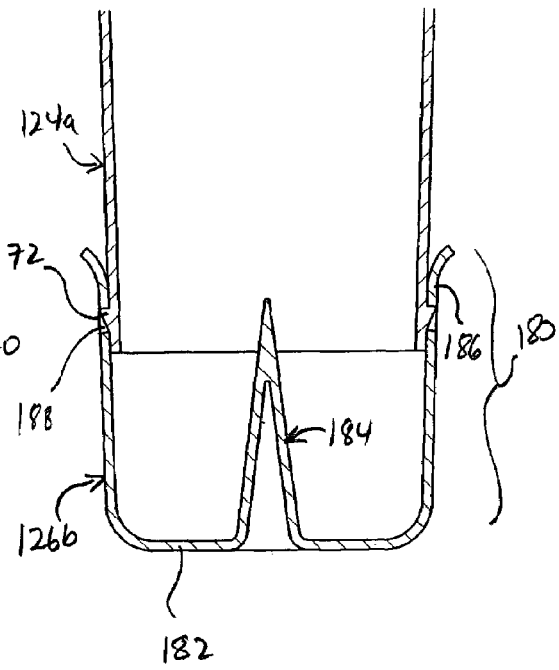
FIG. 17 is a partial sectional view taken through the longitudinal center line of the exemplary holding system of FIG. 16.

FIGS. 16 and 17 depicted an alternative structure for securing a cap portion 126*b* onto a barrel portion 124*a* to form an alternative holding structure 122*a*. The barrel portion 124*b* comprises a first side wall portion 170 having a detent projection 172 and a flange portion 174. An optional belt clip 176 is shown integrally formed with the barrel portion 124*a*. The cap portion 126*b* comprises a second side wall portion 180 and a bottom wall portion 182. A plug projection 184 extends from the bottom wall portion 182. The second side wall portion 180 defines a detent ear 186 in which is formed a detent opening 188.

The detent ears 186 are made of a resilient material that deforms slightly and then returns to its original position. In use, the cap portion 126*b* is displaced towards the barrel portion 124*a* such that the detent ears 186 engage the detent projections 172. Further displacement of the cap portion 126 causes the detent projections 172 to deform the detent ears 186.

When the detent projections 172 encounter the detent openings 188, the detent ears 186 return to their original position with the detent projections 172 within the detent openings 188. In this position, the cap portion 126*b* is secured to the barrel portion 124*a*. Displacing the detent ear 186 away from the first side wall portion 170 of the barrel portion 124*a* allows the detent projection 172 to be removed from the detent opening 188 to detach the cap portion 126*b* from the barrel portion 124*a*.

The use of the holding structure 122*a* is substantially the same as the structure 122 described above and will not be described again.

Figure 18:
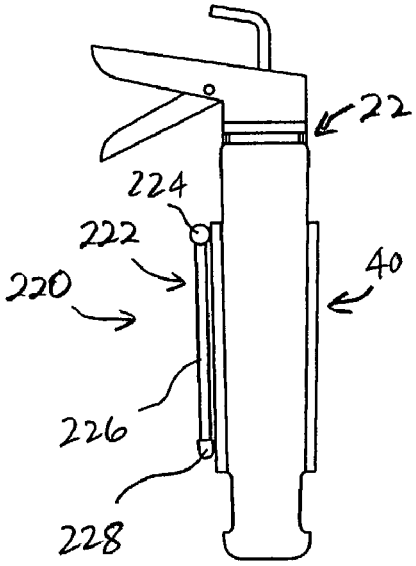
FIGS. 18 and 19 are side elevation views of still another exemplary holding system of the present invention.
Figure 19:
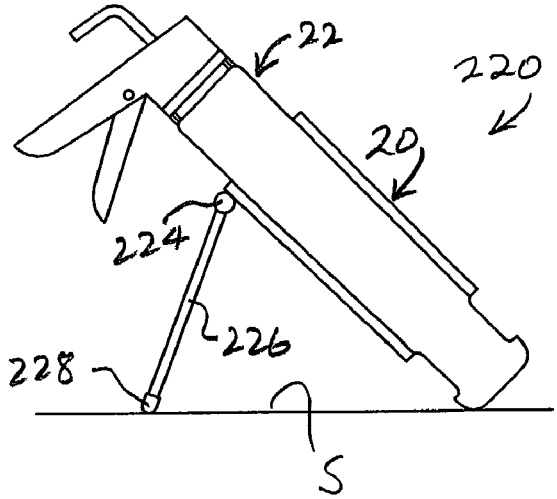

Referring now to FIGS. 18 and 19, depicted therein is yet another holding system 220 constructed in accordance with, and embodying, the principles of the present invention. In particular, the holding system comprises, in addition to the holding structure 40 described above, a support assembly 222.

The support assembly 222 comprises a hinge portion 224, a brace portion 226, and a ground engaging portion 228. The hinge portion 224 is rigidly connected to the holding structure 40. The hinge portion 224 further rotatably attaches the brace portion 226 to the holding structure 40 such that the brace portion 226 rotates between retracted (FIG. 18) and extended (FIG. 19) positions.

With the brace portion 226 in the retracted position, the holding system 220 is used in the same manner as the holding system 20 described above. With the brace portion 226 in the extended position, the holding structure 40 and the ground engaging portion 228 may be placed on a support surface S to maintain the dispensing system 22 in a desired orientation relative to the support surface S. Typically, the dispensing system 22 will be held at an angle relative to the surface S.

Figure 20:
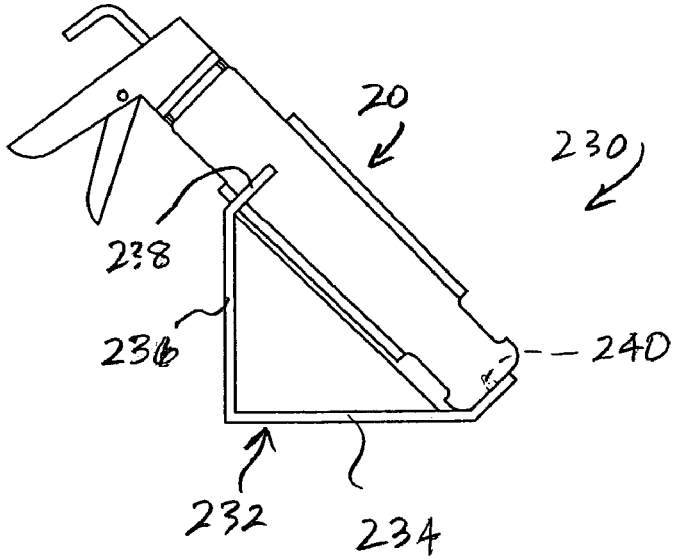
FIG. 20 is a side elevation view of another embodiment of an exemplary holding system of the present invention.

Referring now to FIG. 20, depicted therein is yet another holding system 230 constructed in accordance with, and embodying, the principles of the present invention. In particular, the holding system comprises, in addition to the holding structure 40 described above, a support rack 232.

The support rack 232 comprises a base portion 234, an upright portion 236, and a collar portion 238. Optionally, an alignment projection 240 may be formed in the base portion 234.

In use, the base portion 234 is placed on a support surface with the upright portion 236 supporting the collar portion 238 above the support surface. The holding structure 40 is placed onto the support rack 232 with the collar portion 236 and base portion 234 maintaining the dispensing system 22 in a desired orientation relative to the support surface. The alignment projection 240 may engage the optional projection cavity 56 formed in the holding structure 40 to stabilize the holding system 230. Typically, the dispensing system 22 will be held at an angle relative to the surface.

Figure 21:
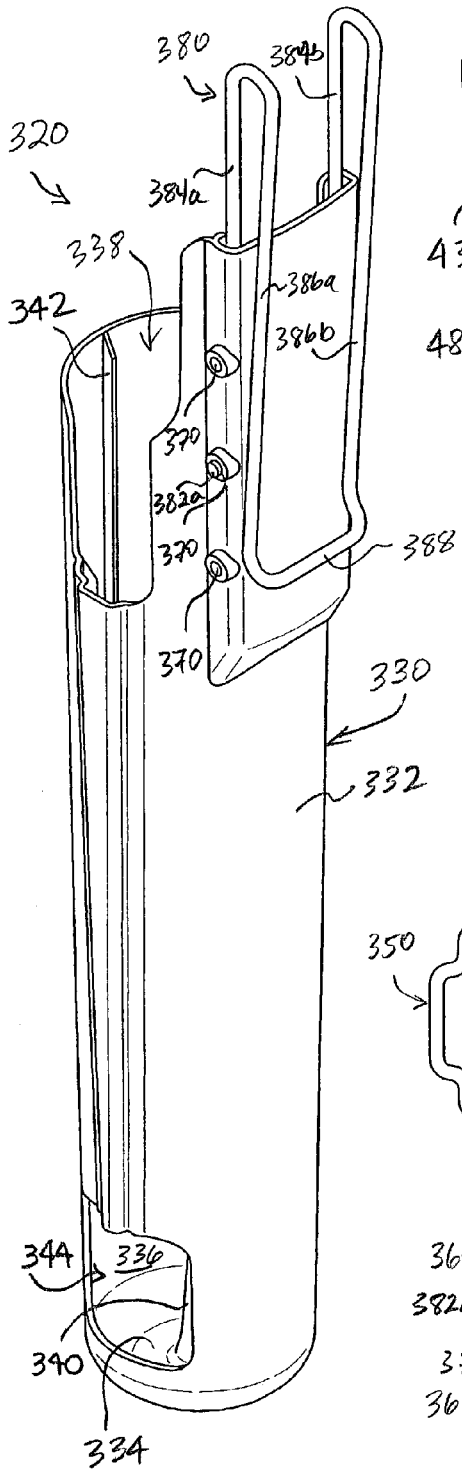
FIG. 21 is a perspective view of another exemplary holding system constructed in accordance with, and embodying, the principles of the present invention.
Figure 22:
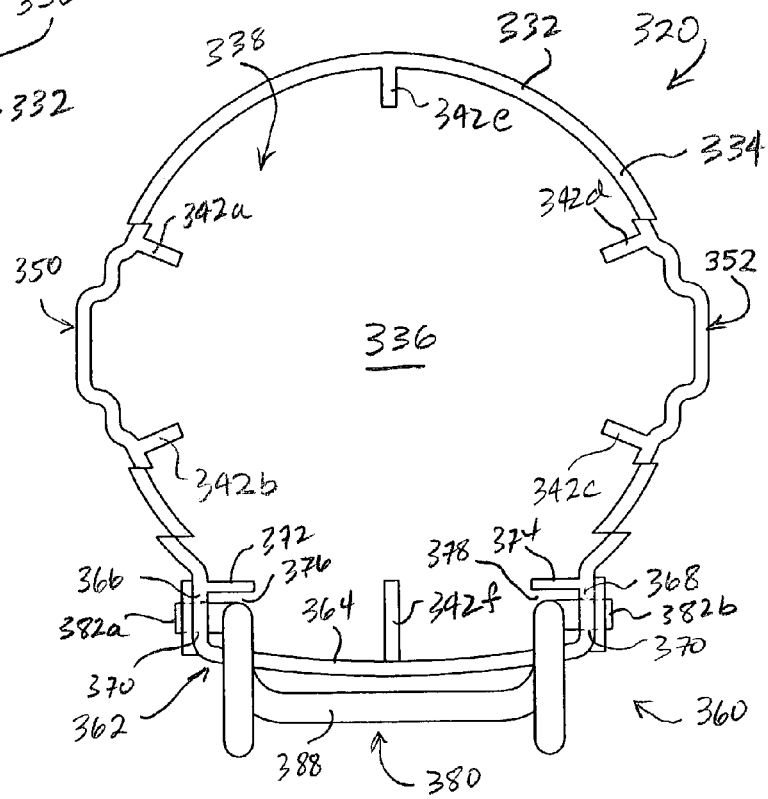
FIG. 22 is a somewhat schematic a top plan view of the holding system of FIG. 21.

Turning now to FIGS. 21 and 22 of the drawing, depicted therein is a holding system 320 constructed in accordance with, and embodying, the principles of another embodiment of the present invention. Like the holding assembly 20 described above, the holding system 320 is adapted to a dispensing assembly like the dispensing assembly 22 described above in a desired relationship from a belt worn by an operator.

FIGS. 21 and 22 show that the holding system 320 comprises a holding structure 330 having a side wall 332 and a bottom wall 334. The holding structure 330 defines a holding chamber 336 and a main opening 338. Extending from the bottom wall 334 into the holding chamber 336 is a plug projection 340. In addition, a plurality of guide ribs 342 extend from the side wall 332 into the holding chamber 336. Optionally, one or more wall openings 344 may be formed in the side wall 332 adjacent to the plug projection 340.

As shown in FIG. 22, the exemplary holding structure 330 comprises six guide ribs 342*a-f*. First and second guide ribs 342*a* and 342*b* are spaced from each other by an angle of approximately 50°, while third and fourth guide ribs 342*c* and 342*d* are spaced from each other by an angle of approximately 50°. The first and third guide ribs 342*a* and 342*c*, are spaced 180° from each other, the second and fourth guide ribs 342*b* and 342*d* are spaced 180° from each other, and the fifth and sixth guide ribs 342*e* and 342*f* are spaced 180° from each other. The angle between the fifth and sixth guide ribs 342*e* and 342*f* and the first, second, third, or fourth guide ribs 342*a-d* adjacent thereto is approximately 70°.

FIG. 22 further shows that first and second wall projections 350 and 352 are formed by the side wall 332. These projections 350 and 352 are spaced approximately 180° from each other and are configured to accommodate projections from certain of the various types of dispensing assemblies accommodated by the holding system 320. The first wall projection 350 is arranged between the first and second guide ribs 342*a* and 342*b*, while the second wall projection 352 is arranged between the third and fourth guide ribs 342*c* and 342*d*.

FIGS. 21 and 22 further illustrate a belt clip system 360 that may optionally be used to facilitate the attachment of the holding structure 330 to the operator's belt as generally described above with reference to FIG. 1. In the exemplary holding system 320, the belt clip system 360 comprises a clip projection 362 extending from the side wall 332. The clip projection 362 is arranged substantially equi-distant from the first and second wall projections 350 and 352. The clip projection 362 is formed on the holding structure 330 adjacent to the main opening 338.

The clip projection 362 defines a bearing wall portion 364 and first and second side wall portions 366 and 368. The sixth guide rib 342*f* extends from the bearing wall portion 364 of the side wall 332. A plurality of clip openings 370 are formed in the side wall portions 366 and 368. Additionally, channel projections 372 and 374 extend from the side wall 332 into the holding chamber 336 adjacent to the side walls 366 and 368 to define clip channels 376 and 378.

The belt clip system 360 further comprises a clip member 380. The exemplary clip member 380 is made out of a relatively strong, resiliently deformable material such as metal wire or plastic. The exemplary clip member 380 defines first and second retaining end portions 382*a,b*, first and second extension portions 384*a,b*, first and second side portions 386*a,b*, and a cross portion 388.

When not deformed, a distance between the retaining end portions 382*a,b* of the clip member 380 is greater than a distance between the side wall portions 366 and 368. To attach the clip member 380 to the holding structure 330, the extension portions 382*a,b* are forced together to deform the clip member 380 such that the distance between the end portions 382*a,b* is less than the distance between the side wall portions 366 and 368. The end portions 382*a,b* may then be inserted into the clip channels 376 and 378.

When the clip member 380 is in a desired position to the holding structure 330, the extension portions 382*a,b* are released to allow the end portions 382*a,b* to enter a pair of clip openings 370 corresponding to the desired position. The end portions 382*a,b* engage the side wall portions 366 and 368 at the openings 370 such that loads on the holding structure 330 are transmitted to the clip member 380. The side portion 386*a,b* and cross portion 388 are inserted behind a structural member such as a user's belt to support the holding structure from the structural member. Depending upon which pair of clip openings 370 receive the end portions 382*a,b*, the holding structure 330 hangs higher or lower on the user's belt.

Turning now to FIGS. 23-26 of the drawing, depicted therein is a holding system 420 constructed in accordance with, and embodying, the principles of the present invention. Like the holding assemblies 20 and 320 described above, the holding system 420 operates in a hanging configuration (FIGS. 23, 25B, and 26) in which the holding system 420 is suspended from a structural member such as a belt worn by an operator. In addition, like the holding systems 220 and 230 described above, the holding system 420 can operate in a free-standing configuration (FIGS. 24 and 25A) in which the holding system 420 rests on a support surface S.

FIGS. 23 and 24 best show that the holding system 420 comprises a holding structure 430 having a side wall 432 and a bottom wall 434. The holding structure 430 defines a holding chamber 436 and a main opening 438. Extending from the bottom wall 434 into the holding chamber 436 is a plug projection 440. In addition, a plurality of guide ribs 442 extend from the side wall 432 into the holding chamber 436. Optionally, one or more wall openings 444 may be formed in the side wall 432 adjacent to the plug projection 440.

FIGS. 21-26 further illustrate a support system 450 that may optionally be used to support the holding structure 430 in the hanging or free-standing configurations described above.

In the exemplary holding system 420, the belt clip system 450 comprises a support projection 452 extending from the side wall 432. The support projection 452 defines a bearing wall portion 454 and first and second side wall portions 456 and 458. The support projection 452 is formed on the holding structure 430 adjacent to the main opening 438. A plurality of clip openings 460 are formed in the side wall portions 456 and 458. Channel projections 462 and 464 extend into the holding chamber 436 adjacent to the side wall portions 456 and 458 to define clip channels 466 and 468.

In addition, as shown in FIGS. 24 and 25, extending outwardly from the side wall 432 are first, second, and third brace projections 470, 472, and 474. The first and second brace projections are located at substantially the same axial location along the holding structure 430 but are radially spaced from each other. The exemplary third brace projection 474 is axially spaced between the first and second brace projections 470 and 472 and the bottom wall 434. The third brace projection 474 is also radially located between the first and second brace projection 470 and 472. The first and second brace projections define first and second pivot openings 476 (FIG. 25) and 478 (FIG. 24). While two third brace projections 474 are shown in FIG. 24, one or more than two of these projections 474 may be used.

The belt clip system 450 further comprises a support member 480. The exemplary support member 480 is made out of a relatively strong, resiliently deformable material such as metal wire or plastic. The exemplary support member 480 defines first and second retaining end portions 482*a,b*, first and second extension portions 484*a,b*, first and second side portions 486*a,b*, and a cross portion 488.

To place the holding system 420 in the hanging configuration, the support member 480 is attached to the holding structure 430 as shown in FIG. 25B. In particular, when the support member 480 is not deformed, a distance between the retaining end portions 482*a,b* of the support member 480 is greater than a distance between the side wall portions 456 and 458. To attach the support member 480 to the holding structure 430, the extension portions 482*a,b* are forced together to deform the support member 480 such that the distance between the end portions 482*a,b* is less than the distance between the side wall portions 456 and 458. The end portions 482*a,b* are then inserted into the clip channels 466 and 468.

When the support member 480 is in a desired position to the holding structure 430, the extension portions 482*a,b* are released to allow the end portions 482*a,b* to enter a pair of clip openings 460 corresponding to the desired position. The end portions 482*a,b* engage the side wall portions 456 and 458 at the openings 460 such that loads on the holding structure 430 are transmitted to the support member 480. The side portion 486*a,b* and cross portion 488 are inserted behind a structural member such as a user's belt to support the holding structure from the structural member. Depending upon which pair of clip openings 460 receive the end portions 482*a,b*, the holding structure 430 hangs higher or lower on the user's belt.

To place the holding system 420 in the free-standing configuration, the support member 480 is attached to the holding structure 430 as shown in FIG. 25A. In particular, the extension portions 482*a,b* are forced together to deform the support member 480 such that the distance between the end portions 482*a,b* is less than the distance between the first and second brace projections 470 and 472. The end portions 482*a,b* are then inserted into the brace openings 476 and 478 in the brace projections 470 and 472. The support member 480 is next rotated towards the bottom wall 434 until the cross portion 488 thereof engages the third bracing projection 474. The bracing projection 474 may be contoured to form a snap fit that positively grips and holds the cross portion 488 in place.

When the support system 420 is in the free-standing configuration, the first and second extension portions 484*a,b* and first and second side portions 486*a,b* form first and second "legs" of the support system 420. The holding structure 430 forms a third "leg" when the bottom wall 434 engages the surface S such that the support system 420 contacts the support surface S at three points. When the support member 480 is attached to the holding structure 430 in the free-standing configuration, a tri-pod arrangement is thus created that allows the support system 420 to maintain a dispensing assembly in an upright position on the support surface S.

Optionally, a brace plate 490 may be provided. The brace plate 490 is a generally flat, rectangular plate having corners defining bracing edge portions 492. Edge notch portions 494 are formed in the edge of the brace plate 490 between the bracing edge portions 492. In addition, extending from the brace plate 490 are one or more clip projections 496.

The optional brace plate 490 may be secured to the support member 480 to enhance the stability of the holding system 420 when in the free-standing configuration. In particular, as shown in FIG. 25A, the clip projections 496 are sized, located, and dimensioned to engage the extension portions 484*a,b* and detachably attach the brace plate 490 to the support member 480. When attached to the support member 480, the bracing edge portions 492 of the brace plate 490 extend to either side of the side portion 486*a,b* of the support member 480 to improve the stability of the holding system 20 in the free-standing configuration. The notch portions 494 improve stability on uneven surfaces.

Figure 26:
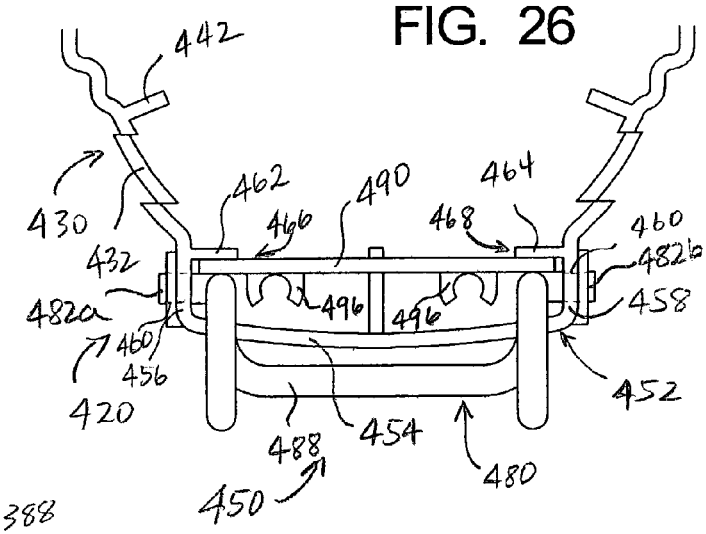
FIG. 26 is a somewhat schematic a top plan view of the holding system of FIG. 23.

Additionally, as perhaps best shown in FIG. 26, the optional brace plate 490 is not required and thus may be stored within the support projection 452 when the holding system 20 is in the hanging system 20. In particular, the brace plate 490 may be stored in the clip channels 466 and 468 between the channel projections 462 and 464 and the extension portions 484*a,b* of the support member 480.

Given the foregoing, it should be clear to one of ordinary skill in the art that the present invention may be embodied in forms other than those described above. The scope of the present invention should be determined by the following claims and not the foregoing detailed description.

I claim:

1. A holding system for a dispensing system for hardenable materials, the dispensing system comprising a dispensing gun and a product cartridge having a dispensing tip defining a dispensing opening, the holding system comprising:

a holding structure comprising a side wall and a bottom wall, where the holding structure defines a main opening, at least one wall opening, and a holding chamber, whereby the holding chamber is sized and dimensioned to receive at least a portion of the dispensing system;

a plug projection extending from the bottom wall into the holding chamber, where the at least one wall opening is arranged to allow access to the plug projection within the holding chamber; and a plurality of guide ribs that extend from the side wall into the holding chamber a major portion of said plug projection extending beyond a bottom edge of said wall opening; whereby the holding chamber is sized and dimensioned to receive the dispensing system; and as the dispensing system is placed into the holding chamber, at least one of the guide ribs engages a portion of the dispensing system to facilitate entry of the plug projection into the dispensing opening; and as the dispensing system is placed within the holding chamber, entry of the plug projection into the dispensing opening can further be facilitated by reaching through the at least one wall opening.

2. A holding system as recited in claim 1, further comprising a support assembly attached to the holding structure, where the support assembly supports the holding structure in a desired orientation relative to a support surface.

3. A holding system as recited in claim 1, further comprising a support rack, where the support rack engages the holding structure to support the holding structure in a desired orientation relative to a support surface.

4. A holding system as recited in claim 1, in which the guide ribs define a central portion of the holding chamber and at least one perimeter portion of the holding chamber, where the guide ribs and at least one perimeter portion are sized, dimensioned, and located to allow the dispensing system to be displaced into the holding chamber such that the plug projection may enter the dispensing opening.

5. A holding system as recited in claim 1, further comprising a belt clip secured to the holding structure, where the belt clip allows the holding structure to be suspended from a belt worn by an operator.

6. A holding system as recited in claim 1, further comprising a clip member and a plurality of pairs of clip openings formed in the holding structure, where the clip member is deformable such that extension portions of the clip member engage a selected one of the pairs of clip openings to determine a location of the clip member relative to the holding structure.

7. A holding system as recited in claim 1, in which the holding structure comprises a barrel portion and a cap portion, where:

the barrel portion defines a portion of the side wall;

the cap portion defines a portion of the side wall and the bottom wall; and the cap portion is detachably attached to the barrel portion to facilitate access to the plug projection.

8. A holding system as recited in claim 1, in which the holding structure comprises a container portion and a projection member, where:

the container portion defines the side wall and the bottom wall; and the projection member is detachably attached to the container portion such that the projection member defines the plug projection.

9. A method of holding a dispensing system for hardenable materials, the dispensing system comprising a dispensing gun and a product cartridge having a dispensing tip defining a dispensing opening, the method comprising the steps of:

providing a holding structure comprising a side wall and a bottom wall, where the holding structure defines a main opening, at least one wall opening formed in the side wall, and a holding chamber, the holding chamber is sized and dimensioned to receive at least a portion of the dispensing system, and the at least one wall opening is formed adjacent to the plug projection, a major portion of said plug projection extending beyond a bottom edge of said wall opening;

forming a plug projection on the bottom wall of the holding structure, where the plug projection extends into the holding chamber; and forming at least one guide rib on the side wall of the holding structure, where the at least one guide rib extends into the holding chamber;

displacing the product cartridge into the holding chamber such that the guide rib engages a portion of the dispensing system to facilitate entry of the plug projection into the dispensing opening; and reaching through the at least one wall opening to facilitate entry of the plug projection into the dispensing opening.

10. A method as recited in claim 9, further comprising the steps of:

forming a support projection on the holding structure;

forming first, second, and third brace projections one the holding structure;

securing a support member to the support projection to place the support system in a hanging configuration; and securing the support member to the brace projections to place the support system in a free-standing configuration.

11. A method as recited in claim 9, in which the step of providing the holding structure comprises the steps of:

providing a barrel portion and a cap portion; and detachably attaching the cap portion to the barrel portion such that the barrel portion defines a portion of the side wall and the cap portion defines a portion of the side wall and the bottom wall.

12. A method as recited in claim 9, in which the step of providing the holding structure comprises the steps of:

providing a container portion and a projection member; and detachably attaching the projection member to the container portion such that the projection member defines the plug projection.

13. A method as recited in claim 9, further comprising the steps of:

attaching a support assembly to the holding structure; and arranging the support assembly in a retracted configuration; and arranging the support assembly in an extended configuration in which the support assembly supports the holding structure in a desired orientation relative to a support surface.

14. A method as recited in claim 9, further comprising the steps of:

providing a support rack; and arranging the holding structure on the support rack such that the support rack supports the holding structure in a desired orientation relative to a support surface.

15. A holding system for a dispensing system for hardenable materials, the dispensing system comprising a dispensing gun and a product cartridge having a dispensing tip defining a dispensing opening, the holding system comprising:

a holding structure comprising a side wall and a bottom wall, where the holding structure defines a main opening, a holding chamber, and at least one wall opening;

a plug projection extending from the bottom wall into the holding chamber, where the at least one wall opening is arranged to allow access to the plug projection within the holding chamber a major portion of said plug projection extending beyond a bottom edge of said wall opening; and a plurality of guide ribs extending from the side wall into the holding chamber; whereby the holding chamber is sized and dimensioned to receive at least a portion of the dispensing system; and when the dispensing system is placed into the holding chamber, at least one of the guide ribs engages the dispensing system to facilitate entry of the plug projection into the dispensing opening; and when the dispensing system is placed into the holding chamber, entry of the plug projection into the dispensing opening may further be facilitated by reaching through the wall opening.

16. A holding system as recited in claim 15, in which the guide ribs define a central portion of the holding chamber and at least one perimeter portion of the holding chamber, where the guide ribs and at least one perimeter portion are sized, dimensioned, and located to allow the dispensing system to be displaced into the holding chamber such that the plug projection may enter the dispensing opening.

17. A holding system as recited in claim 15, in which the holding structure comprises a barrel portion and a cap portion, where:

the barrel portion defines a portion of the side wall;

the cap portion defines a portion of the side wall and the bottom wall; and the cap portion is detachably attached to the barrel portion to facilitate access to the plug projection.

18. A holding system as recited in claim 15, in which the holding structure comprises a container portion and a projection member, where:

the container portion defines the side wall and the bottom wall; and the projection member is detachably attached to the container portion such that the projection member defines the plug projection.

19. A holding system as recited in claim 1, further comprising a support system comprising:

a support projection formed on the holding structure;

first, second, and third brace projections extending from the holding structure; and a support member; wherein the support member engages the support projection to place the support system in a hanging configuration; and the support member engages the brace projections to place the support system in a free-standing configuration.

20. A holding system as recited in claim 15, further comprising a support system comprising:

a support projection formed on the holding structure;

first, second, and third brace projections extending from the holding structure; and a support member; wherein the support member engages the support projection to place the support system in a hanging configuration; and the support member engages the brace projections to place the support system in a free-standing configuration.

* * * * *